US009533868B2

(12) United States Patent
Wauters

(10) Patent No.: US 9,533,868 B2
(45) Date of Patent: Jan. 3, 2017

(54) CONTAINER WITH PRESSURE RELIEF VALVE

(71) Applicant: Dispack-projects NV, Destelbergen (BE)

(72) Inventor: Albert Marie Wauters, Destelbergen (BE)

(73) Assignee: Dispack-projects NV, Destelbergen (BE)

( * ) Notice: Subject to any disclaimer, the term of this patent is extended or adjusted under 35 U.S.C. 154(b) by 0 days.

(21) Appl. No.: 14/396,969

(22) PCT Filed: Apr. 25, 2013

(86) PCT No.: PCT/BE2013/000022

§ 371 (c)(1),
(2) Date: Oct. 24, 2014

(87) PCT Pub. No.: WO2013/159159

PCT Pub. Date: Oct. 31, 2013

(65) Prior Publication Data

US 2015/0108175 A1 Apr. 23, 2015

(30) Foreign Application Priority Data

Apr. 27, 2012 (WO) ..... PCT/BE2012/000020
Nov. 19, 2012 (BE) ..... 2012/0775

(51) Int. Cl.

| | |
|---|---|
| ***B65D 83/00*** | (2006.01) |
| ***B67D 1/00*** | (2006.01) |
| ***B67D 1/12*** | (2006.01) |
| *B67D 1/08* | (2006.01) |
| *B67D 7/02* | (2010.01) |

(52) U.S. Cl.

CPC ..... *B67D 1/125* (2013.01); *B67D 1/0832* (2013.01); *B67D 1/0802* (2013.01); *B67D 1/0829* (2013.01); *B67D 1/0831* (2013.01); *B67D 1/0838* (2013.01); *B67D 7/0288* (2013.01); *Y10T 137/314* (2015.04)

(58) Field of Classification Search

CPC ..... B67D 1/125; B67D 1/0832; B67D 1/0831; B67D 1/0802; B67D 1/0838; B67D 7/0288; B67D 1/0829; B65D 51/1683; Y10T 137/2713; Y10T 137/314; Y10T 137/6137

See application file for complete search history.

(56) References Cited

U.S. PATENT DOCUMENTS

| | | | | |
|---|---|---|---|---|
| 3,228,413 A * | 1/1966 | Stevens, Jr. | B67D 1/0831 | 137/322 |
| RE27,626 E * | 4/1973 | Johnston | B67D 1/0832 | 222/400.7 |
| 3,939,860 A * | 2/1976 | Golding | B67D 1/0832 | 137/212 |

(Continued)

*Primary Examiner* — Frederick C Nicolas
(74) *Attorney, Agent, or Firm* — The Webb Law Firm

(57) ABSTRACT

A container for a fluid under pressure, preferably a beer keg, including a neck and a fitting mounted thereon with a suction tube for drawing the fluid into the container. A pressure relief valve is mounted in an upper end of the suction tube or in the neck of the container. The pressure relief valve includes a closing body which is mounted resiliently via a spring and movable from a closing position to an open position by the spring being compressed.

19 Claims, 11 Drawing Sheets

(56) References Cited

U.S. PATENT DOCUMENTS

| | | | | | |
|---|---|---|---|---|---|
| 4,406,301 | A * | 9/1983 | Cerrato | B67D 1/0832 | 137/212 |
| 4,529,105 | A * | 7/1985 | Lewins | B67D 1/0832 | 137/212 |
| 4,548,343 | A * | 10/1985 | Gotch | B67D 1/0832 | 137/212 |
| 5,415,329 | A * | 5/1995 | Westlund | B67D 1/125 | 222/397 |
| 5,645,192 | A * | 7/1997 | Amidzich | B65D 83/48 | 137/212 |
| 6,109,485 | A * | 8/2000 | Amidzich | B67D 1/0802 | 137/212 |
| 6,286,730 | B1 * | 9/2001 | Amidzich | B67D 1/0802 | 137/212 |
| 6,311,875 | B1 * | 11/2001 | Anderson | B67D 1/0832 | 222/396 |
| 6,463,957 | B1 * | 10/2002 | Ozawa | F16L 37/36 | 137/614 |
| 8,602,270 | B2 * | 12/2013 | Takanohashi | B65D 51/1683 | 137/212 |
| 2012/0181289 | A1 * | 7/2012 | Apps | B65D 11/08 | 220/592.19 |

* cited by examiner

CONTAINER WITH PRESSURE RELIEF VALVE

CROSS-REFERENCE TO RELATED APPLICATIONS

This application is the United States national phase of International Application No. PCT/BE2013/000022 filed Apr. 25, 2013, and claims priority to International Patent Application No. PCT/BE2012/0000020 and Belgium Patent Application No. 2012/0775, filed Apr. 27, 2012 and Nov. 19, 2012, respectively, the disclosures of which are hereby incorporated in their entirety by reference.

BACKGROUND OF THE INVENTION

Field of the Invention

The present invention relates to a pressure relief valve, in particular a pressure relief valve for use in a container or keg for a fluid under pressure, such as carbonated beverages, particularly beer.

Description of Related Art

Existing pressure relief valves have the drawback of usually not being very compact and comprising several components which are difficult to recycle.

The invention has for its object to provide a container with a pressure relief valve which is compact and reliable.

SUMMARY OF THE INVENTION

The invention provides for this purpose a container for a fluid under pressure, preferably for carbonated beverages, comprising a fitting with a suction tube for drawing the fluid into the container, wherein a pressure relief valve is mounted in an upper end of the suction tube or is mounted in a neck of the container. The pressure relief valve comprises a closing body which is mounted resiliently and movable from a closing position to an open position by a spring being compressed.

An embodiment mounted in the suction tube has the advantage that the pressure relief valve can be mounted in a convenient manner in the fitting and that the container itself need not be modified. An embodiment mounted in the neck can result in a very compact embodiment, wherein the pressure relief valve can for instance be incorporated or built. into a fitting body provided in the container.

The closing body is preferably mounted resiliently via a spring means such that, as a result of a pressure above a determined critical pressure, the spring means is compressed in order to move the closing body from a closing position to an open position.

When mounted in the suction tube, the pressure relief valve is preferably mounted vertically, i.e. the closing body is vertically movable between the closing position and the open position.

In the case of the embodiment in the suction tube, the upper end of the suction tube is preferably provided with a cap with a hole, which hole is sealed by the closing body in the closing position of the closing body. Note that the cap can be formed integrally with the suction tube but can also form part of a component which can be attached or coupled on or in the suction tube. The cap can for instance also form part of a housing arranged resiliently in or on the suction tube. The hole and the closing body preferably have a shape such that the closing body can be pressed outward out of the cap. When the pressure relief valve opens, the fluid can flow outward through this hole. According to an alternative, the upper end of the suction tube is open and the closing body is received in the closing position in sealing manner in this open end.

The closing body preferably comprises a clamping part and a spring support for a spring means, wherein the clamping part is connected to the spring support and the spring means acts between the spring support and the suction tube or the neck of the container such that, when the pressure in the container exceeds a critical value, the spring support compresses the spring means due to this pressure and so presses the clamping part outward. In the case a cap is provided on the upper end of the suction tube, the spring means preferably acts between the spring support and the cap of the suction tube.

The closing body preferably comprises a central part with a first end on which the clamping part is provided and a second end on which the spring support is provided, wherein the spring means is a spring arranged around the central part. The central part is preferably substantially cylindrical. The clamping part is preferably formed integrally on the central part, although it can also be connected via a clamping connection to the central part. The spring support preferably extends annularly around the central part and is preferably provided with an upright peripheral wall such that an outer end of a spring can be received between the central part and the upright peripheral wall.

According to an advantageous embodiment, the closing body comprises a clamping part which can be received in sealing manner in an opening, wherein the opening and the clamping part have a shape such that the clamping part can be pressed out of the opening in a direction moving from inside the keg to the outside. The opening is for instance provided in a cap on the upper end of the suction tube or in the neck of the container. Seen in the press-out direction, the clamping part preferably has a diverging form such that the clamping part is movable outward but not inward. The clamping part can for instance substantially take the form of a truncated cone or pyramid.

The clamping part is preferably mounted rotatably between the closing position and an open position, this such that the clamping part moves outward out of the opening by being rotated. Here the clamping part and the opening are preferably non-rotation-symmetrical such that a rotation of the clamping part brings about an outward movement of the clamping part. If the clamping part is for instance provided with a recess for coupling to the head of a screwdriver, or with another coupling option, the coupling part can be rotated manually so as to release the pressure from the keg. In addition to the automatic opening of the valve as a result of too high a pressure in the container, the valve can also be opened manually in this way. This is particularly useful when the keg is empty and the user can release the pressure for safety reasons where and when this is required. Viewed perpendicularly of the opening, the clamping part can for instance have a width dimension and a length dimension which differ from each other, while the clamping part, as seen in the press-out direction, has a diverging form. In this way the clamping part can be placed in an open position by rotating the clamping part through 90 degrees.

According to a possible embodiment, the suction tube is provided with one or more openings for passage of fluid out of the keg and the pressure relief valve is arranged substantially above the one or more openings.

According to an advantageous embodiment, the pressure relief valve comprises a clamping part, a spring support and a spring means. The clamping part is connected to the spring support and the spring means acts between the spring support and the suction tube or neck such that, when the pressure in the container exceeds a critical value (for instance a value between 5 and 7 bar), the spring support presses the clamping part outward counter to the action of the spring means. The spring support is preferably an integral piece, for instance manufactured by injection moulding, comprising a base and a connecting shaft directed upward from the base, which connecting shaft is mounted on or in the clamping part.

The clamping part can for instance be provided for this purpose with a recess into which the outer end of the connecting shaft can be pressed, wherein the shape of the recess and of the outer end are such that the connecting shaft is secured in the clamping part. The connection between the clamping part and the connecting shaft can for instance be a dovetail connection.

According to an advantageous embodiment, the clamping part is manufactured from a plastic material which is more compressible than the plastic material from which the spring support is manufactured. The clamping part can for instance be manufactured from an EPDM (ethylene propylene diene monomer) material or an NBR (nitrile butadiene rubber) material, preferably with good sealing properties, while the spring support can for instance be manufactured from a harder plastic material such as PET.

According to an alternative embodiment, the clamping part and the spring support are manufactured from the same material. A separate seal can in this case be arranged around the clamping part, for instance a separate O-ring or an overmoulded elastic rubber, this guaranteeing the seal. The clamping part and the spring support can then be manufactured from for instance a PET material.

According to yet another possible embodiment, the pressure relief valve comprises a housing mounted in sealed manner in an upper end of the suction tube or in the neck. The housing is provided at the bottom with a lower opening and at the top with an upper opening. A closing part is resiliently mounted in the housing via a spring means, for instance in order to close the lower opening. The mounting is then such that this closing part can be pressed out of the lower opening into the housing while the spring means is compressed, when the pressure in the container exceeds a determined critical value. Such a critical pressure lies for instance between 5 and 7 bar.

BRIEF DESCRIPTION OF THE DRAWINGS

The present invention will be further elucidated on the basis of a number of by no means limitative exemplary embodiments of the assembly according to the invention, with reference to the accompanying drawings, in which.

DESCRIPTION OF THE INVENTION

Figure 1A:
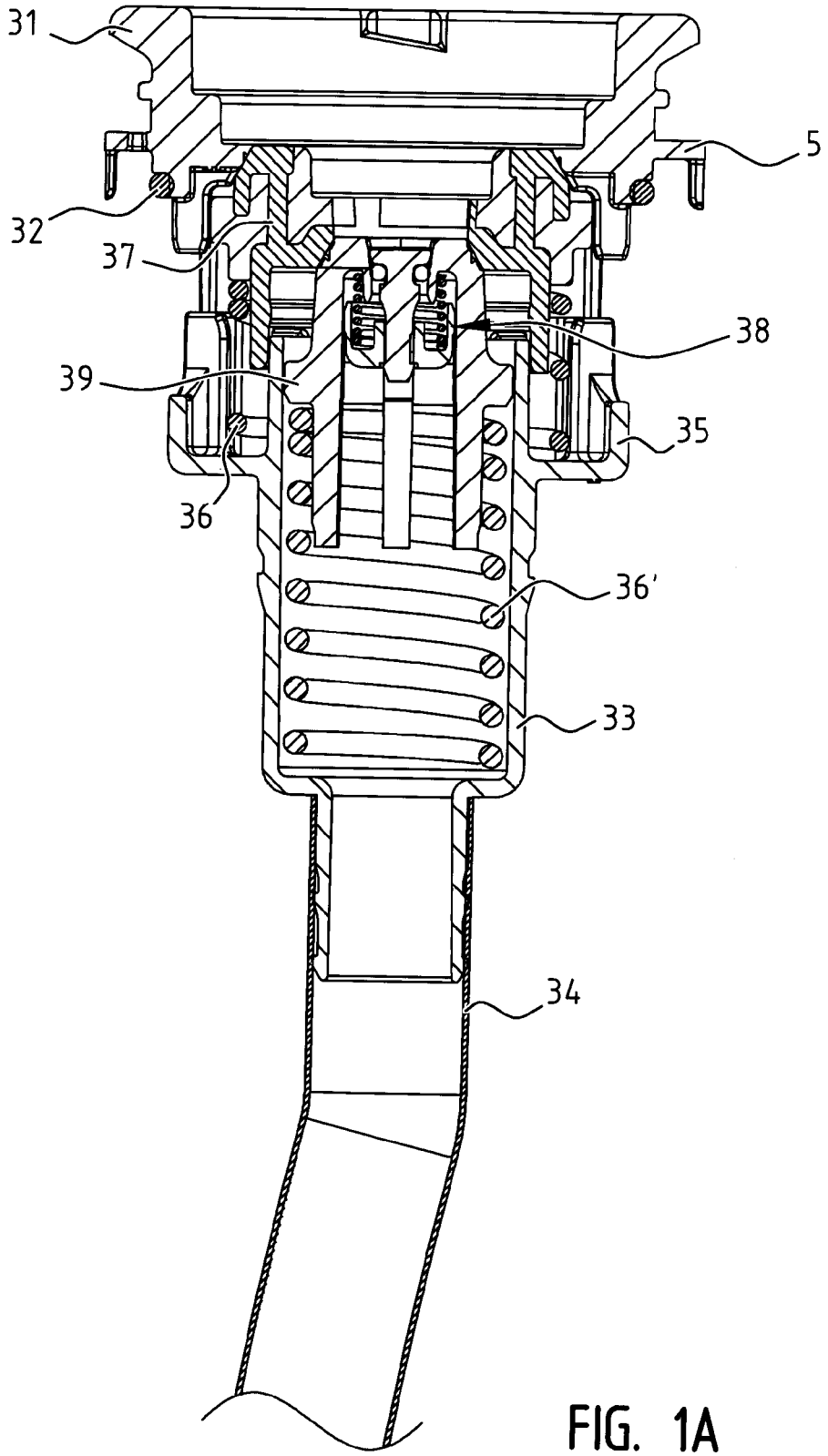
FIG. 1A is a schematic cross-section of an embodiment of a fitting of the S-type according to the invention.
Figure 2A:
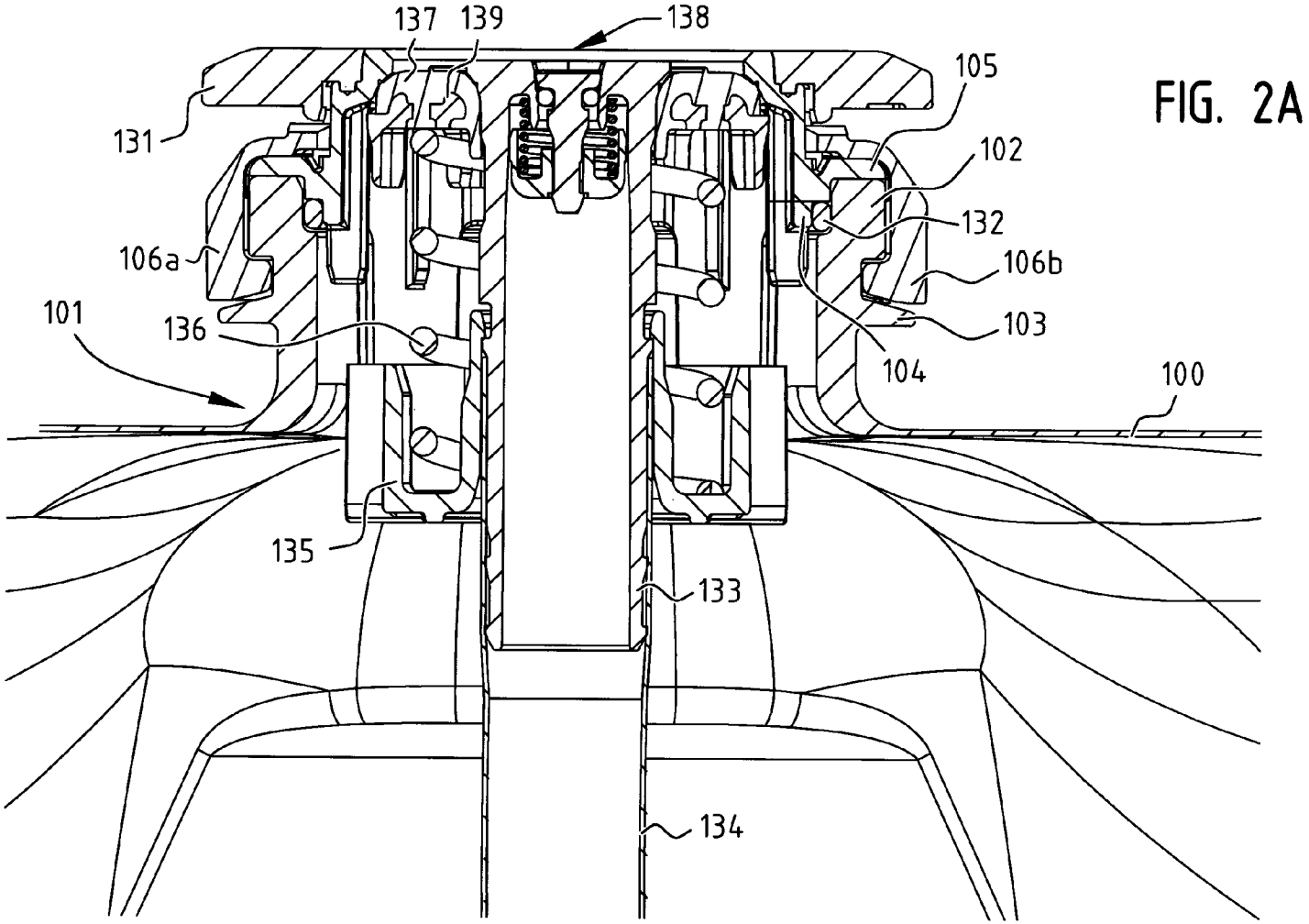
FIG. 2A is a schematic cross-section of an embodiment of a fitting of the A-type according to the invention.

FIG. 1A illustrates an embodiment of a fitting of the S-type, while FIG. 2A shows an embodiment of a fitting of the A-type mounted on a plastic keg 100, of which only the upper part with a neck 101 is shown in FIG. 2A. FIG. 1A shows only the fitting and not the container. Neck 101 is provided with two thickened neck portions, here in the form of neck rings 102, 103 formed integrally with neck 101 of keg 100, extending along the periphery of the neck. Keg 100 is typically manufactured by blow moulding, particularly by stretch blow moulding, preferably from one of the following materials: a PET material, in particular bottle grade PET, a PP material, a PE material or a PEN material. This latter is typically used for reusable kegs. The skilled person will appreciate that the invention is equally applicable to so-called one-way kegs as to reusable kegs. Keg 100 is typically configured to store a liquid under a pressure lying between 0.25 bar and 10.00 bar, preferably between 0.50 bar and 3.50 bar.

Figure 1B:
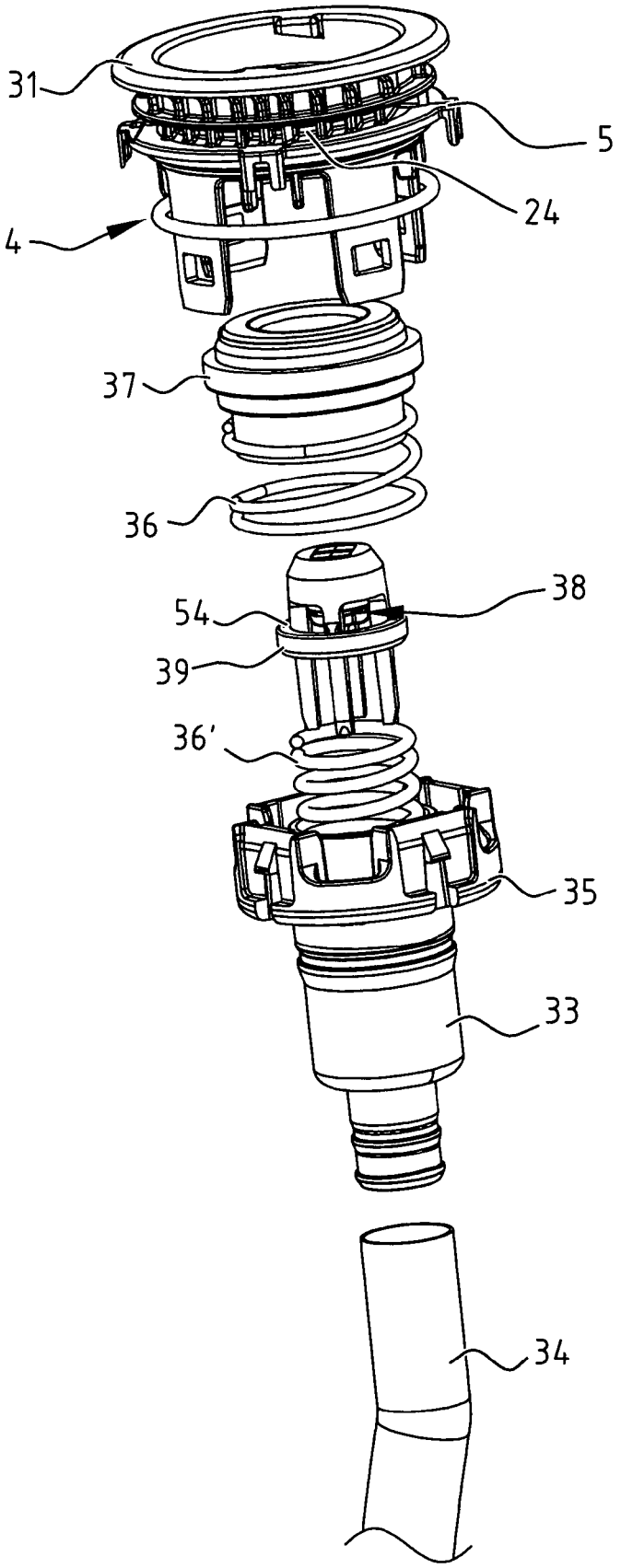
FIG. 1B is an exploded perspective view of the embodiment of FIG. 1A.
Figure 2B:
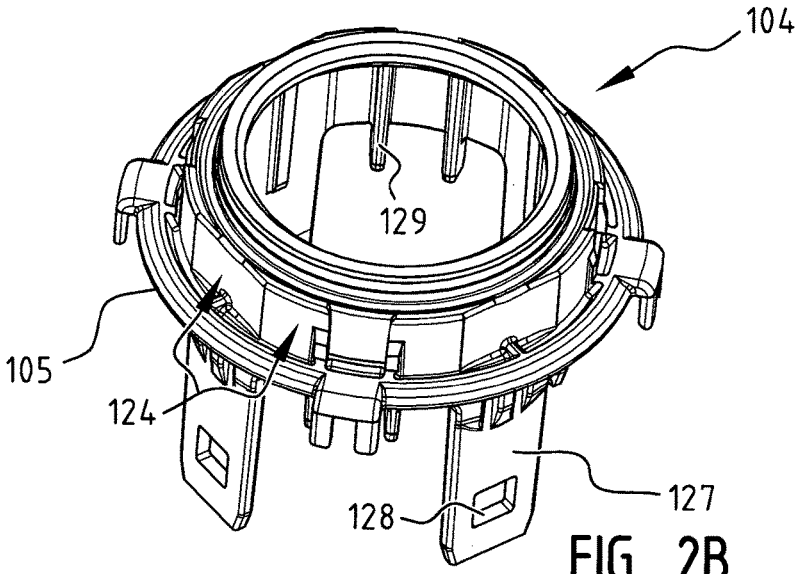
FIG. 2B is a schematic perspective view of the fitting body of the embodiment of FIG. 2A as seen from the top.

The fitting of the S-type or of the A-type comprises respectively a fitting body 4; 104 (see also FIGS. 1B and 2B). Fitting body 4; 104 can be attached with two or more ring sections 106*a*, 106*b* which form a ring around neck 101. Fitting body 4; 104 is provided along its periphery with a profiling 24 (the ribs protruding to greater or lesser extent); 124 (the flat surfaces), see FIGS. 1B and 2B, and the two ring sections 106*a*, 106*b* are provided with a complementary profiling for a non-rotatable positioning. Fitting body 4; 104 is further provided with a support flange 5; 105 and intended for the purpose of receiving different fitting components which make it possible for instance to supply a gas while liquid is being discharged from the keg. The following fitting components can be distinguished in respectively FIGS. 1A and 2A or 2B: a cap 31; 131, a sealing ring 32; 132 for the seal between fitting body 4; 104 and neck 101, a suction tube 33, 34; 133, 134 for drawing the fluid into keg 100, a suction tube mounting piece 35; 135, valve components 37 and 39; 137 and 139, a spring means 36, 36'; 136 for exerting a spring action against valve components 37 and 39; 137 and 139, a pressure relief valve 38, 138. These are only two embodiments, and the skilled person will appreciate that the fitting can also be constructed in other manner. Embodiments of the invention can be applied to a random type of fitting for a keg.

The embodiment illustrated in FIGS. 2A and 2B is intended for co-action with a keg coupling of the A or G-type. The embodiment illustrated in FIGS. 1A and 1B is intended for co-action with a keg coupling of the S-type. The keg coupling is the component which is mounted on the upper side of the fitting and will allow fluid, typically beer, to flow out of the keg while gas flows in so as to keep the keg pressurized. In addition to the A, G and S-keg couplings, there are also keg couplings of the D, U and M type. The fitting will be embodied somewhat differently for these types, although the skilled person will appreciate that the invention is equally applicable to such fittings.

Figure 2D:
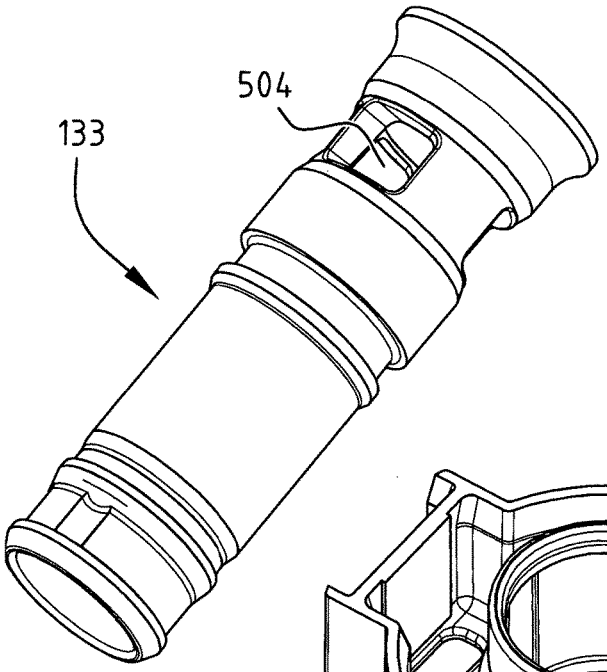
FIG. 2D is a schematic perspective view of a part of the suction tube of the embodiment of FIG. 2A.
Figure 2C:
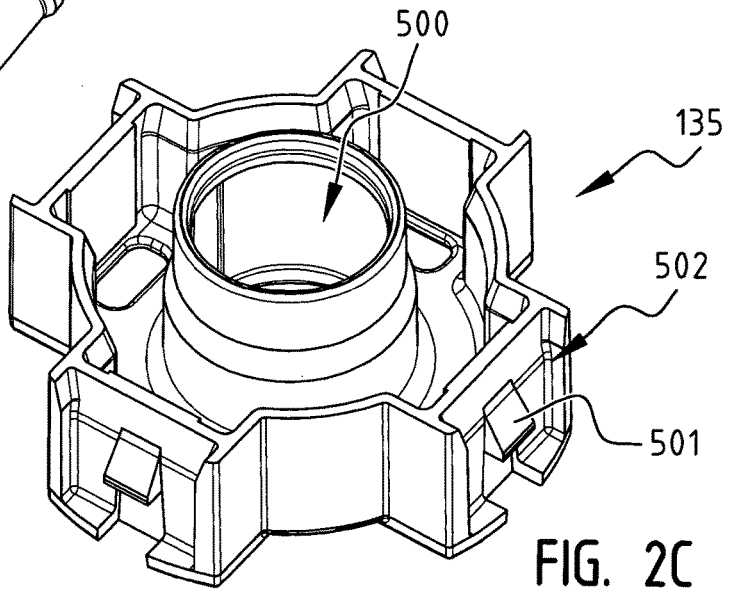
FIG. 2C is a schematic perspective view of the suction tube mounting piece of the embodiment of FIG. 2A.

FIG. 2C illustrates in detail the suction tube mounting piece 135 for the embodiment of the A-type fitting. This piece is provided with a central opening 500 in which the suction tube part 133 illustrated in FIG. 2D can be fixed. The suction tube mounting piece 135 is further provided at its periphery with receiving parts 502 for tongues 127 of fitting body 104, see FIG. 2B. The downward directed tongues 127 are provided on the underside of fitting body 104 and are each provided with a hole 128 in which a protruding part 501 provided in receiving part 502 can engage in each case. The suction tube mounting piece 135 can in this way be locked in fitting body 104 on the underside thereof. The suction tube component 133 is provided with openings 504 for passage of fluid from the keg. In the variant of FIGS. 1A and 1B the suction tube part 33 and mounting piece 35 are manufactured from one piece in which a resiliently mounted upper piece 39 is arranged. This upper piece 39 is provided with openings 54 for passage of fluid from the keg. The attachment of mounting piece 35 to fitting body 4 is similar to the variant of FIGS. 2A and 2B and will therefore not be described in detail.

Referring to FIG. 1A or 2A, it is noted that pressure relief valve 38, 138, which is provided in the shown embodiment at the top of the suction tube, could also be provided at one or more other locations. A number of pressure relief valves could for instance be provided against a wall of fitting body 104, for instance at the lower end thereof, wherein a suitable connection then has to be arranged in neck 101 of keg 100. Such an embodiment is illustrated in FIGS. 9A-9C and 10A-B.

Figure 9A:
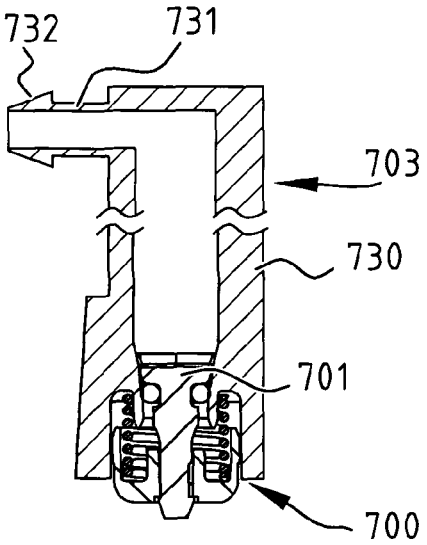
FIGS. 9A, 9B and 9C illustrate a first alternative embodiment in which the pressure relief valve is provided in the neck.
Figure 9B:
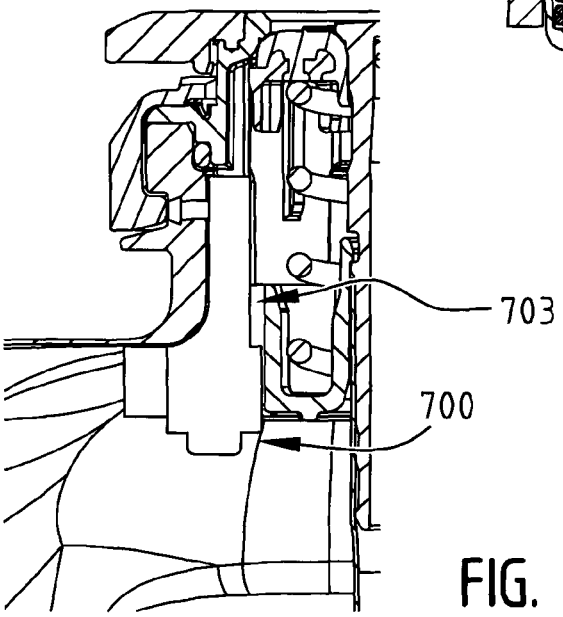
Figure 9C:
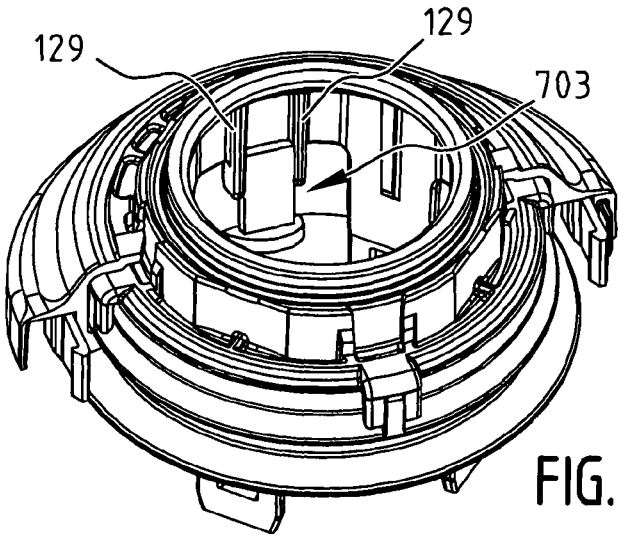

FIGS. 9A-C illustrate a pressure relief valve 700 comprising a housing 703 and a closing body 701 received resiliently therein. Closing body 701 is similar to closing body 601 and will be further described in more detail with reference to FIGS. 6A-6E and FIG. 7. Housing 703 has a vertical tube part 730 which leads to an outlet pipe 731 which can be mounted in a wall of the keg, for instance in the neck of a keg as illustrated in FIG. 9B. A seal, for instance a conical seal 732, can be provided between the neck wall and outlet pipe 731. Referring to FIGS. 9B and 9C, one or more pressure relief valves 700 can then be arranged in the keg prior to placing of fitting body 104, wherein outlet pipe 731 is for instance mounted in the neck wall via conical seal 732. Fitting body 104 can then be placed. Fitting body 104 is advantageously provided with vertical, downward protruding ribs 129, wherein tube part 730 can be received between vertical ribs 129. These ribs 129 thus provide for a further retention and positioning of pressure relief valve 700.

Figure 10A:
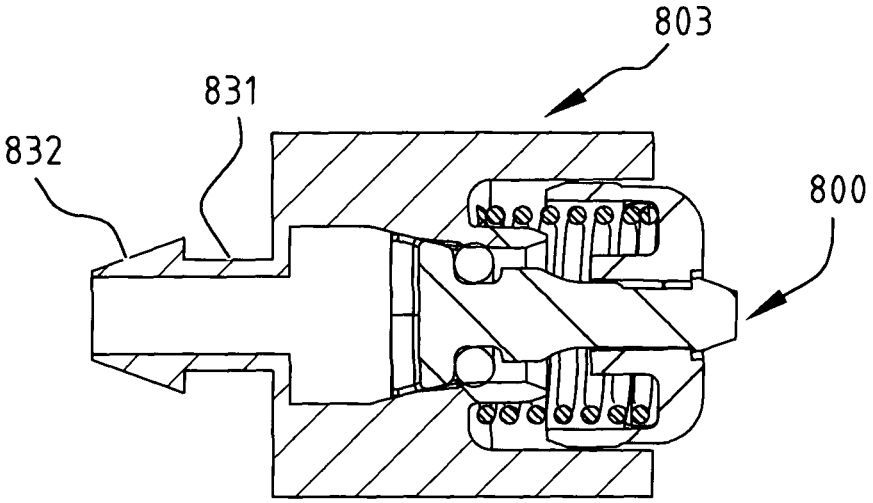
FIGS. 10A and 10B illustrate a second alternative embodiment in which the pressure relief valve is provided in the neck.
Figure 10B:
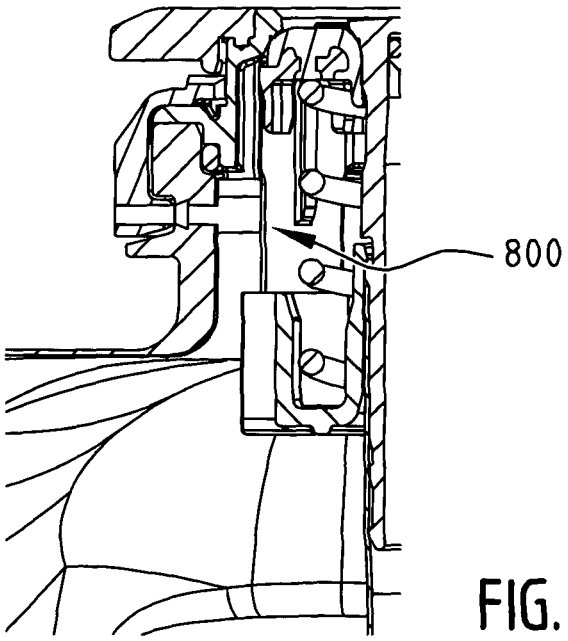

FIGS. 10A-B illustrate a further, second variant of a pressure relief valve 800 connected via the neck of the keg. The pressure relief valve is horizontally mounted here in a housing 803 with an outlet pipe 831 which can be mounted in a wall of the keg, for instance in the neck of a keg. A seal, for instance a conical seal 832, can be provided between the neck wall and outlet pipe 831.

Figure 4:
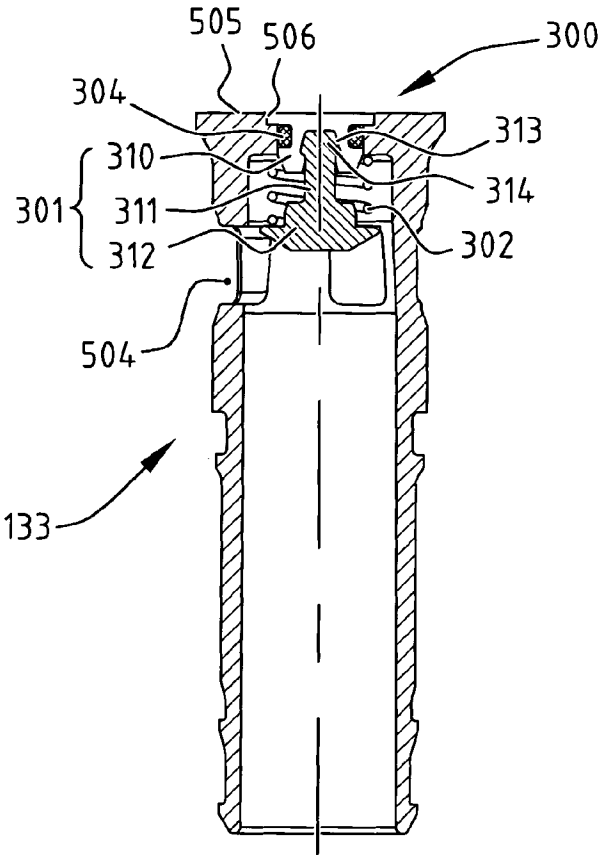
FIG. 4 illustrates a cross-section of an embodiment of a pressure relief valve according to the invention mounted in a suction tube.
Figure 3:
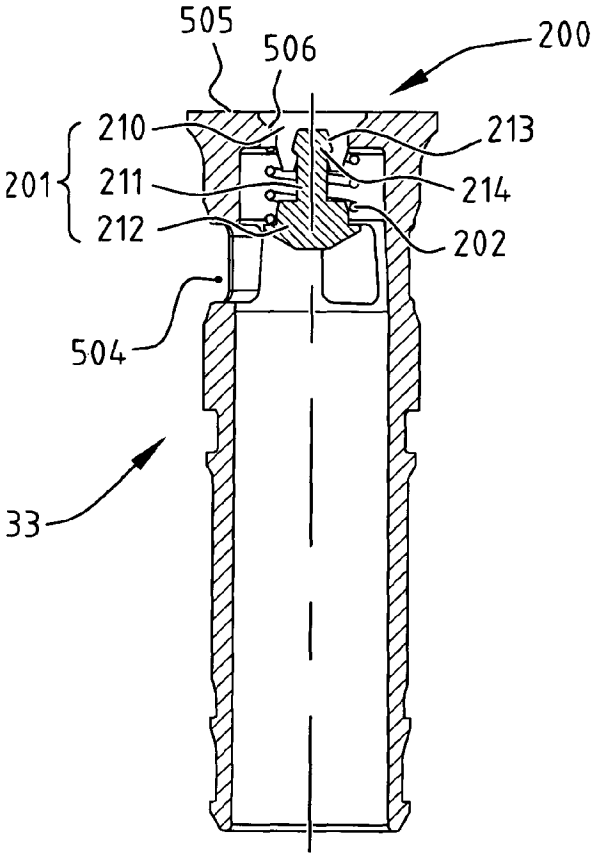
FIG. 3 illustrates a cross-section of an embodiment of a pressure relief valve according to the invention mounted in a suction tube.

FIGS. 3 and 4 illustrate two respective embodiments of pressure relief valves 200, 300 according to the invention intended for mounting in a suction tube of a container for a fluid under pressure, typically a beer keg. The container and fitting can for instance be embodied as has been described above, but can also take a different form. The pressure relief valve 200, 300 is mounted in an upper end of suction tube 133 for drawing the fluid into the container. Suction tube 133 is provided with openings 504 for passage of fluid from the keg, and pressure relief valve 200, 300 is arranged above openings 504. The upper end of the suction tube is closed by a closing cap 505 with a hole 506 through which fluid can escape when pressure relief valve 200 opens.

In the variant of FIGS. 3 and 4 the pressure relief valve 200, 300 comprises a closing body 201, 301 and a spring 202, 302. Closing body 201, 301 comprises a clamping part 210, 310 which is received in sealing manner in hole 506 of the closing cap.

Hole 506 and clamping part 210, 310 have a shape such that the clamping part can be pressed from the inner side of the suction tube out of closing cap 505. Clamping part 210, 310 can for instance be conical or pyramid-shaped. Closing body 201, 301 further comprises a spring support 212, 312 for spring 202, 302. Clamping part 210, 310 is connected to spring support 212, 312, and spring 202, 302 acts between spring support 212, 312 and closing cap 505 such that, when the pressure in the container exceeds a critical value, the spring support presses clamping part 210, 310 outward counter to the action of the spring. In this variant the spring support 212, 312 is an integrally manufactured piece with a base and a connecting shaft 211, 311 directed upward from the base and attached to or in the clamping part. In the shown variant the clamping part 210, 310 is provided with a recess 213, 313 into which the outer end 214, 314 of connecting shaft 211, 311 can be pressed. The shape of the recess and the outer end are such that the connecting shaft is fixed in the clamping part. In the illustrated embodiment the connection between the clamping part and the connecting shaft is a dovetail connection, although the skilled person will appreciate that other connections are also possible.

In the variant of FIG. 3 the clamping part is manufactured from a plastic material which is more compressible than the plastic material from which the spring support is manufactured, and the material of the clamping part itself provides the sealing. The clamping part is then for instance manufactured from an EPDM (ethylene propylene diene monomer) material or an NBR (nitrile butadiene rubber) material. In the variant of FIG. 4 the clamping part and the spring support can be manufactured from the same material and a sealing ring 304 is arranged around the clamping part. Both spring support 312 and clamping part 310 can for instance be manufactured in this case from a PET material.

Figure 5A:
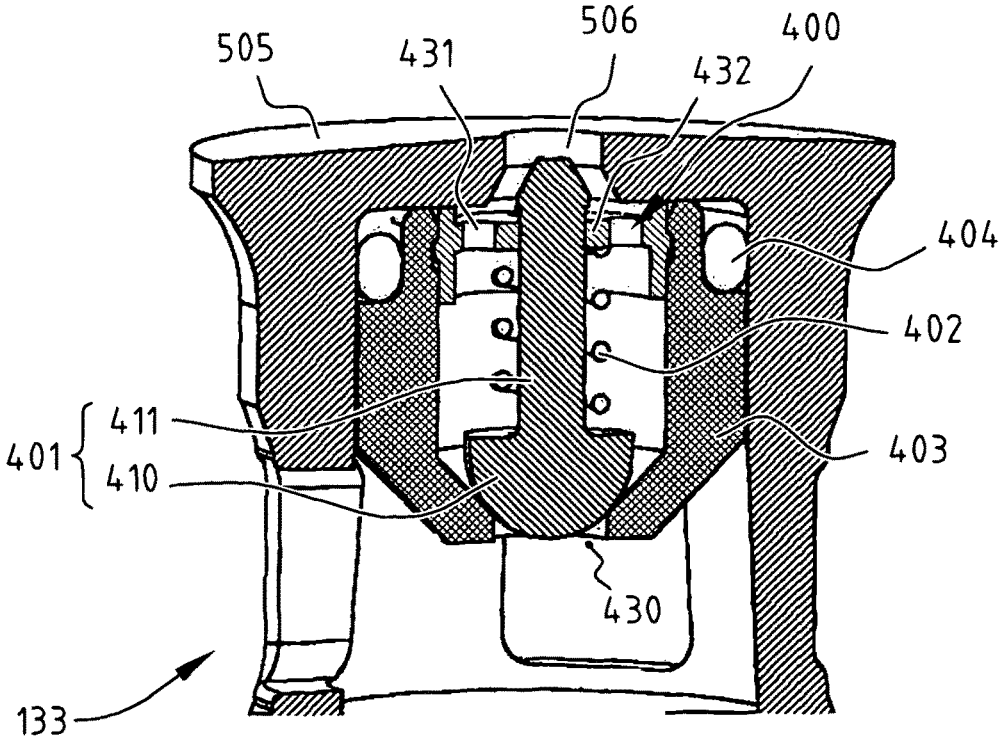
FIGS. 5A and 5B show respectively a cross-section and a perspective view of an embodiment of a pressure relief valve according to the invention mounted in a suction tube.
Figure 5B:
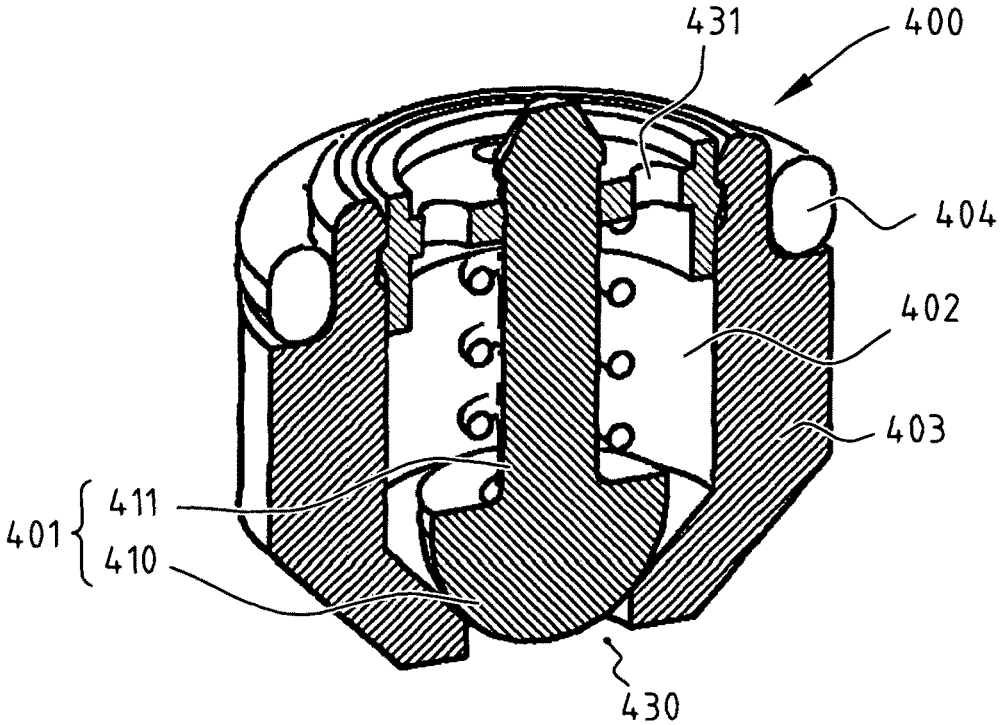

FIGS. 5A and 5B illustrate another embodiment of a pressure relief valve 400 according to the invention. In this embodiment the pressure relief valve comprises a closing body 401 and spring 402 which are accommodated in a housing 403 mounted via a sealing ring 404 in an upper end of the suction tube. Housing 403 is provided at the bottom with a lower opening 430 and at the top with upper openings 431. Closing body 401 is mounted resiliently in the housing by means of a spring 402. Closing body 401 has a base part 410 configured to close lower opening 430 and a shaft part 411 which is directed upward from base part 410 and around which spring 402 is provided. Spring 402 acts between base part 410 and an upper wall 432 of housing 403 through which shaft part 411 is guided. It will in this way be possible to press base part 410 into housing 403 counter to the spring action of spring 402 when the pressure in the container exceeds a determined critical value, whereby fluid can escape from the container through lower opening 430 and via upper openings 431 and hole 506.

FIGS. 6A-E, 7 and 8A-C illustrate yet another embodiment of a pressure relief valve according to the invention. In this embodiment the pressure relief valve is mounted in a housing 603, this housing being intended for placing in an upper end of the suction tube, see also FIG. 1A (the housing is designated in FIG. 1A with numeral 39). The pressure relief valve comprises a closing body 601 which is mounted resiliently in housing 603, as shown most clearly in FIG. 7. Closing body 601 comprises a clamping part 610, a connecting piece 611 connecting thereto and a spring support 612. Connecting piece 611 is provided at its outer end with a thickened portion 614, this such that spring support 612 can be clamped fixedly onto connecting piece 611. Spring support 612 is provided for this purpose with a central passage 615. Spring support 612 is shown most clearly in FIG. 6E and comprises a ring 616 connected by means of a number of connecting arms 618 to the central passage 615. A first end of a spring 602 can be received in spring support 612 between inner ring 615 and outer ring 616. The other outer end of spring 602 supports against an upper wall 630 of housing 603. This upper wall 630 is further provided with an opening 606 which in the closing position is closed by clamping part 610. For a good sealing the clamping part 610 can be provided with an O-ring 604. Spring 602 acts between spring support 612 and housing 603. Due to compression of spring 602 closing body 601 will in this way be movable from a closing position (see FIG. 6A) to an open position (see FIG. 8A) as a result of a high pressure in the keg. Since housing 603 is mounted in the suction tube, spring 602 thus acts indirectly between spring support 612 and the suction tube such that, when the pressure in the container exceeds a critical value, spring support 12 compresses spring 602 and clamping part 610 is pressed outward.

Figure 6A:
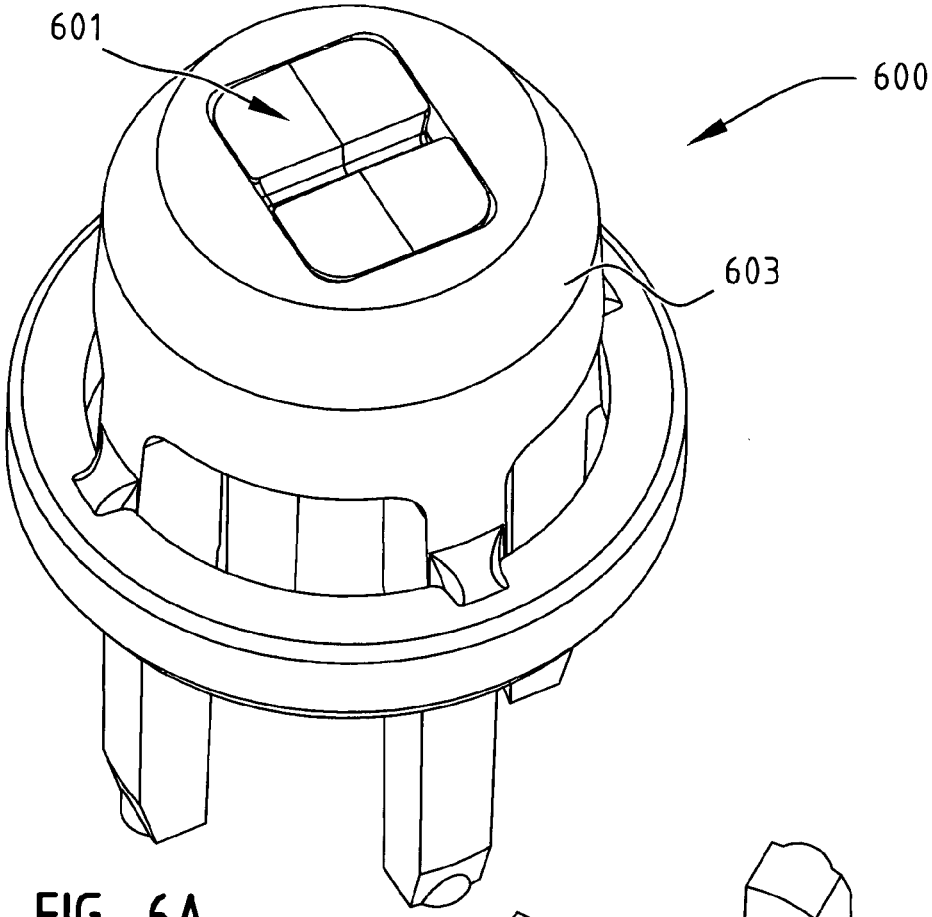
FIGS. 6A, 6B and 6C show respectively a perspective top view of a pressure relief valve, a perspective bottom view thereof and a perspective top view of the pressure relief valve without the closing body.
Figure 6B:
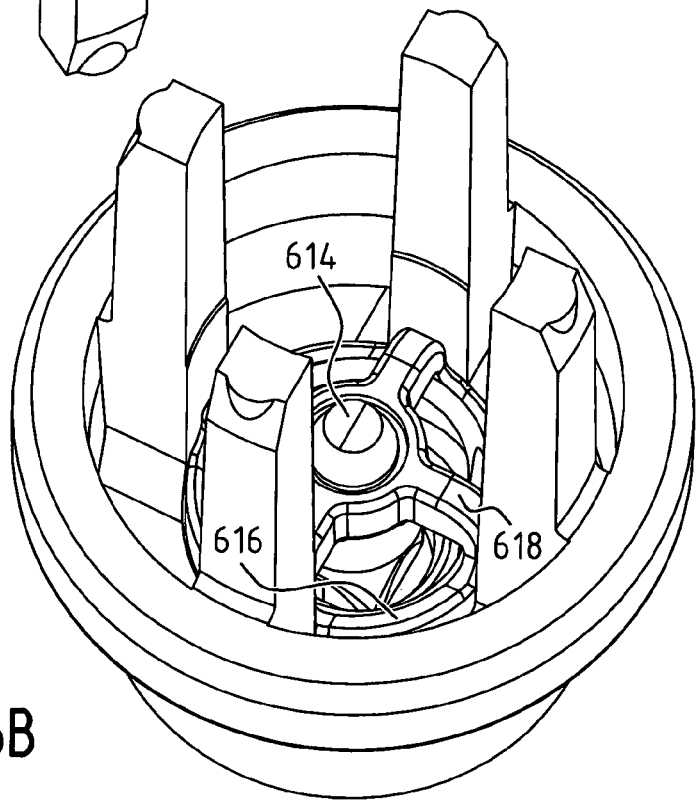
Figure 6C:
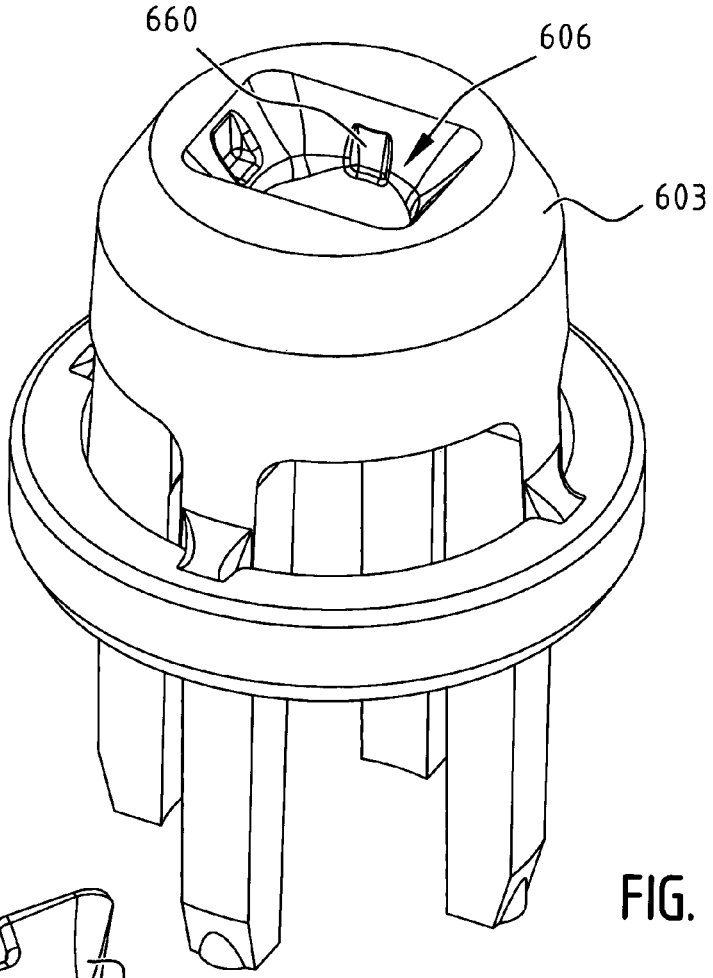
Figure 6D:
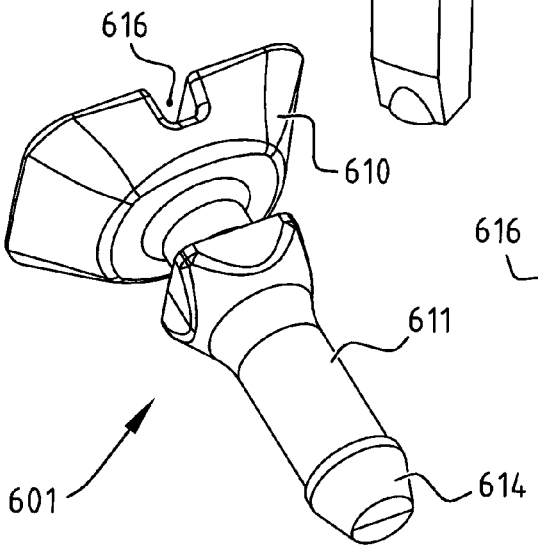
FIG. 6D illustrates a perspective view of a part of the closing body of the embodiment of FIG. 6A.
Figure 6E:
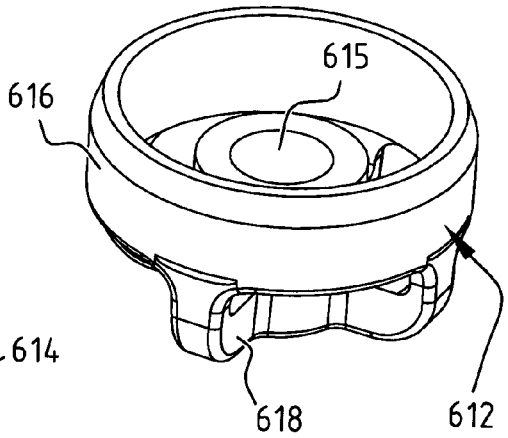
FIG. 6E illustrates a perspective view of the spring support of the embodiment of FIG. 6A.
Figure 7:
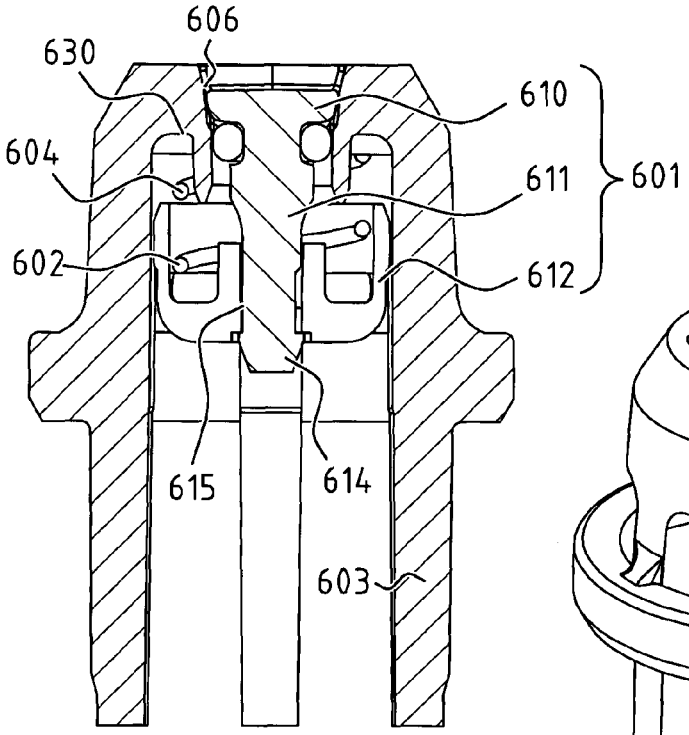
FIG. 7 shows a cross-section through the embodiment of FIG. 6A.
Figure 8A:
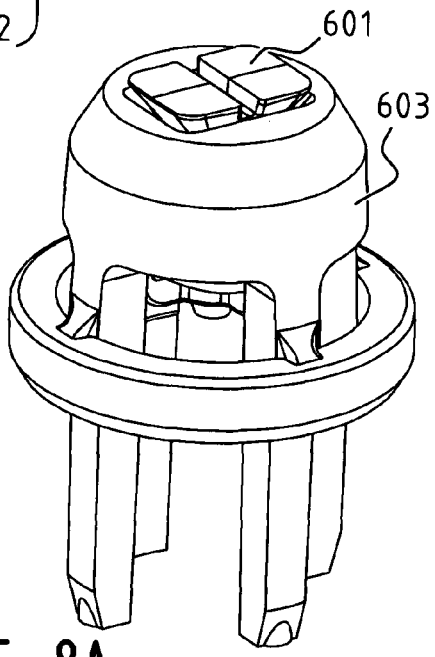
FIGS. 8A-8C show the embodiment of FIG. 6A in three successive positions of the closing body.
Figure 8B:
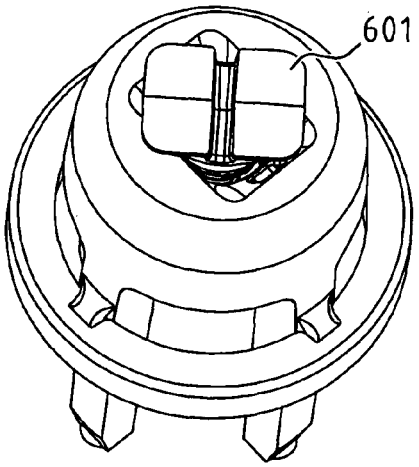
Figure 8C:
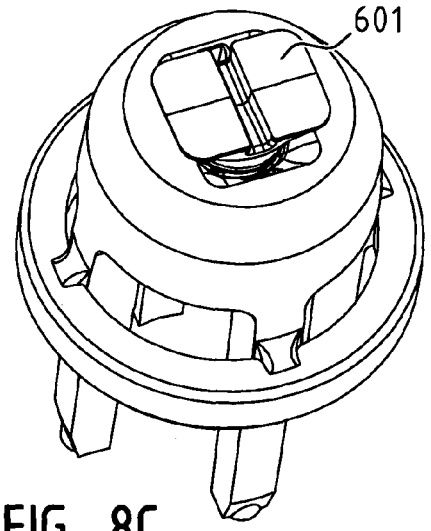

As shown most clearly in FIG. 6D, clamping part 610 has a diverging form as viewed from inside the keg to the outside. Clamping part 610 further has a width dimension differing from the length dimension, and the clamping part is provided on its upper side with a recess 616, here in the form of a groove, in which the head of a tool can be received. A rotation of clamping part 610 will in this way bring about a simultaneous upward movement of the clamping part. Clamping part 610 preferably further has rounded corners and a rounded diverging peripheral part such that clamping part 610 can be rotated smoothly from a closing position to an open position. It will also be possible in this way to release the pressure manually, as best illustrated in FIGS. 8B and 8C, in which two respective positions of clamping part 610 are shown. Clamping part 610 can for instance be rotated by means of a screwdriver, whereby an opening is created through which the pressure can escape from the keg. Note that other shapes are also possible instead of a slotted recess 616, wherein a tool with a head with a complementary shape is then provided for manual opening of the pressure relief valve.

The skilled person will appreciate that the invention is not limited to the above illustrated exemplary embodiments and that many variants can be envisaged without departing from the scope of the invention, which is defined solely by the following claims.

The invention claimed is:

1. A container for a fluid under pressure, comprising: a neck and a fitting mounted thereon with a suction tube for drawing the fluid into the container, wherein a pressure relief valve is mounted in an upper end of the suction tube or in the neck of the container, said pressure relief valve comprising a closing body which is mounted resiliently via a spring element and movable from a closing position to an open position by the spring element being compressed; and wherein the closing body is mounted such that as a result of a pressure in the container exceeding a determined critical pressure, the closing body is moved from a closing position to an open position, wherein the upper end of the suction tube is provided with a cap with a hole, said hole being sealed by the closing body in the closing position of the closing body.

2. A container for a fluid under pressure, comprising: a neck and a fitting mounted thereon with a suction tube for drawing the fluid into the container, wherein a pressure relief valve is mounted in an upper end of the suction tube or in the neck of the container, said pressure relief valve comprising a closing body which is mounted resiliently via a spring element and movable from a closing position to an open position by the spring element being compressed; and wherein the closing body is mounted such that, as a result of a pressure in the container exceeding a determined critical pressure, the closing body is moved from a closing position to an open position, wherein the closing body comprises a clamping part and a spring support for a spring element, wherein the clamping part is connected to the spring support and the spring element acts between the spring support and the suction tube or the neck of the keg such that, when the pressure in the container exceeds a critical value, the spring support presses the clamping part outward counter to the action of the spring element.

3. The container as claimed in claim 2, wherein the spring element acts between the spring support and the cap of the suction tube.

4. The container as claimed in claim 2, wherein the closing body comprises a central part with a first end on which the clamping part is provided and a second end on which the spring support is provided, wherein the spring element is a spring arranged around the central part.

5. The container as claimed in claim 4, wherein the clamping part is formed integrally on the central part.

6. The container as claimed in claim 4, wherein the spring support extends annularly around the central part and is provided with an upright peripheral wall such that an outer end of a spring can be received between the central part and the upright peripheral wall.

7. A container for a fluid under pressure, comprising: a neck and a fitting mounted thereon with a suction tube for drawing the fluid into the container, wherein a pressure relief valve is mounted in an upper end of the suction tube or in the neck of the container, said pressure relief valve comprising a closing body which is mounted resiliently via a spring element and movable from a closing position to an open position by the spring element being compressed; and wherein the closing body is mounted such that, as a result of a pressure in the container exceeding a determined critical pressure, the closing body is moved from a closing position to an open position, wherein the closing body comprises a clamping part and a spring support, and that the spring support is an integral piece comprising a base and a connecting shaft directed upward from the base, which connecting shaft is mounted on or in the clamping part.

8. The container as claimed in claim 7, wherein the clamping part is provided with a recess into which the outer end of the connecting shaft can be pressed, wherein the shape of the recess and of the outer end are such that the connecting shaft is secured in the clamping part.

9. A container for a fluid under pressure, comprising: a neck and a fitting mounted thereon with a suction tube for drawing the fluid into the container, wherein a pressure relief valve is mounted in an upper end of the suction tube or in the neck of the container, said pressure relief valve comprising a closing body which is mounted resiliently via a spring element and movable from a closing position to an open position by the spring element being compressed; and wherein the closing body is mounted such that, as a result of a pressure in the container exceeding a determined critical pressure, the closing body is moved from a closing position to an open position, wherein the closing body comprises a clamping part and a spring support, and wherein the clamping part is manufactured from a plastic material which is more compressible than the plastic material from which the spring support is manufactured.

10. A container for a fluid under pressure, comprising: a neck and a fitting mounted thereon with a suction tube for drawing the fluid into the container, wherein a pressure relief valve is mounted in an upper end of the suction tube or in the neck of the container, said pressure relief valve comprising a closing body which is mounted resiliently via a spring element and movable from a closing position to an open position by the spring element being compressed; and wherein the closing body is mounted such that, as a result of a pressure in the container exceeding a determined critical pressure, the closing body is moved from a closing position to an open position, wherein the pressure relief valve comprises a housing mounted in sealed manner in an upper end of the suction tube or in the neck.

11. The container as claimed in claim 10, wherein the housing is provided at the bottom with a lower opening and at the top with an upper opening, wherein the closing body is resiliently mounted in the housing for the purpose of closing the lower opening, this such that this valve part can be pressed into the housing when the pressure in the container exceeds a determined critical value.

12. A container for a fluid under pressure, comprising: a neck and a fitting mounted thereon with a suction tube for drawing the fluid into the container, wherein a pressure relief valve is mounted in an upper end of the suction tube or in the neck of the container, said pressure relief valve comprising a closing body which is mounted resiliently via a spring element and movable from a closing position to an open position by the spring element being compressed; and wherein the closing body comprises a clamping part which is received in sealing manner in an opening, wherein the opening and the clamping part have a shape such that the clamping part can be pressed outwardly from inside the container, out of the opening, as a result of a pressure in the container exceeding a determined critical pressure.

13. The container as claimed in claim 12, wherein the clamping part has a diverging form in the direction of the movement from closing position to the open position.

14. The container as claimed in claim 12, wherein the clamping part substantially takes the form of a truncated cone or pyramid.

15. The container as claimed in claim 12, wherein the clamping part is mounted rotatably between the closing position and the open position, this such that the clamping part moves outward out of the opening during the rotation.

16. The container as claimed in claim 12, wherein the clamping part and the opening are non-rotation-symmetrical such that a rotation of the clamping part brings about an outward movement of the clamping part.

17. The container as claimed in claim 12, wherein the clamping part, viewed perpendicularly of the opening, has a width dimension and a length dimension which differ from each other.

18. The container as claimed in claim 12, wherein the clamping part is provided with a recess or a protruding part intended for coupling to the head of a tool.

19. The container as claimed in claim 12, wherein the suction tube is provided with at least one opening for passage of fluid out of the keg; and wherein the pressure relief valve is arranged above the at least one opening.

* * * * *